US007264445B2

(12) United States Patent
Naik et al.

(10) Patent No.: US 7,264,445 B2
(45) Date of Patent: Sep. 4, 2007

(54) COOLED BLADE OR VANE FOR A GAS TURBINE

(75) Inventors: Shailandra Naik, Gebenstorf (CH); Sacha Parneix, Mulhouse (FR); Ulrich Rathmann, Baden (CH); Helene Saxer-Felici, Mellingen (CH); Stefan Schlechtriem, Taegerig (CH); Beat Von Arx, Trimbach (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 11/330,268

(22) Filed: Jan. 12, 2006

(65) Prior Publication Data

US 2006/0177310 A1 Aug. 10, 2006

Related U.S. Application Data

(63) Continuation of application No. PCT/EP2004/051309, filed on Jun. 30, 2004.

(30) Foreign Application Priority Data

Jul. 12, 2003 (DE) ..... 103 31 635

(51) Int. Cl.
*F01D 5/18* (2006.01)

(52) U.S. Cl. ..... 416/97 R; 415/115

(58) Field of Classification Search ..... 416/90 R, 416/91, 96 R, 97 R, 92, 95, 248; 415/115, 415/116

See application file for complete search history.

(56) References Cited

U.S. PATENT DOCUMENTS 3,051,438 A * 8/1962 Page et al. ..... 416/92
3,719,431 A 3/1973 Steele et al.
4,177,010 A 12/1979 Greaves et al.
4,278,400 A * 7/1981 Yamarik et al. ..... 416/97 R
4,761,116 A * 8/1988 Braddy et al. ..... 416/92
5,813,835 A 9/1998 Corsmeier et al.
2002/0119045 A1 8/2002 Starkweather

FOREIGN PATENT DOCUMENTS

GB 817660 8/1959
GB 2 250 548 A 6/1992

* cited by examiner

*Primary Examiner*—Richard A. Edgar
(74) *Attorney, Agent, or Firm*—Buchanan Ingersoll & Rooney PC

(57) ABSTRACT

A cooled blade or vane for a gas turbine has a main blade or vane part which starts from a blade or vane root and a blade or vane shank and has a leading edge and a trailing edge, as well as, inside the main blade or vane part, a plurality of cooling ducts, which extend in the radial direction, are connected in series in terms of flow and of which a first cooling duct has a main stream of a cooling medium flowing through it along the leading edge. A second cooling duct has a main stream of a cooling medium flowing through it along the trailing edge, from the blade or vane root to the tip of the main blade or vane part. The outlet of the first cooling duct is in communication, via a first diverting region, a third cooling duct arranged between the first and second cooling ducts, and a second diverting region, with the inlet of the second cooling duct.

14 Claims, 3 Drawing Sheets

Fig.2
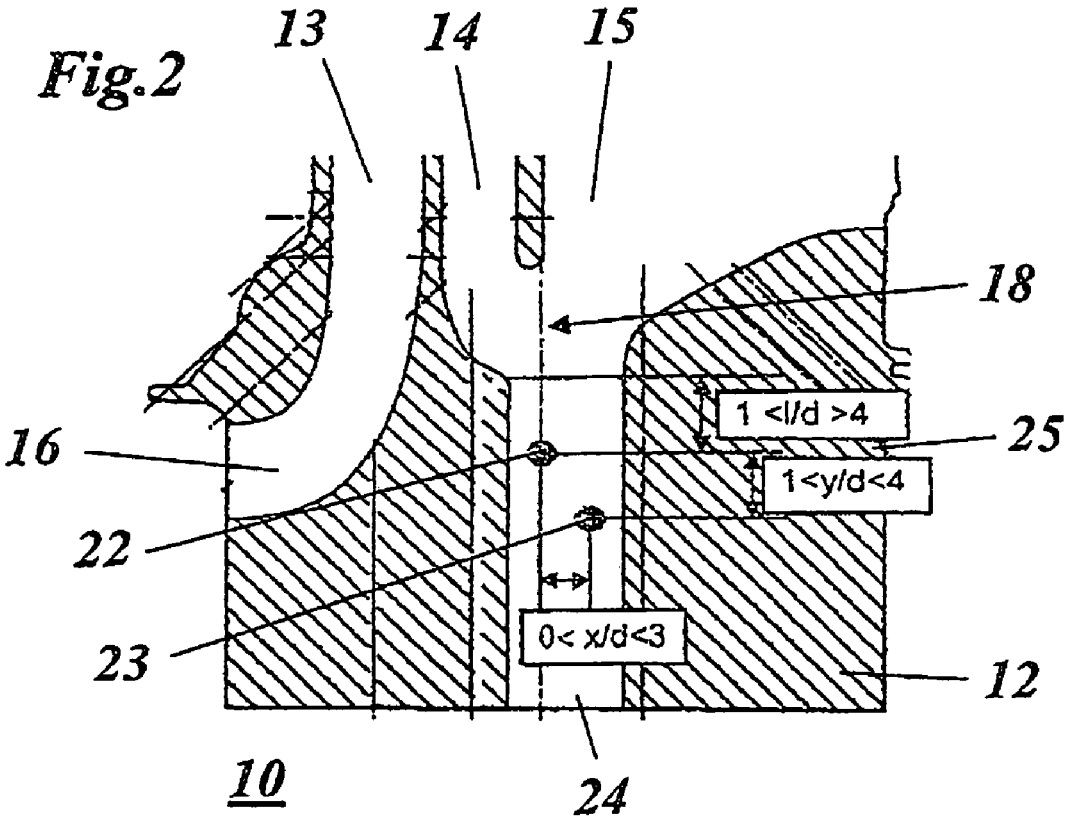
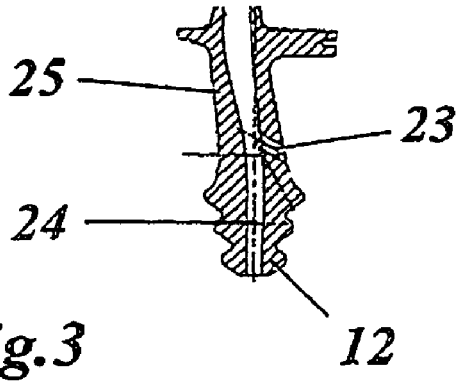
Fig.3
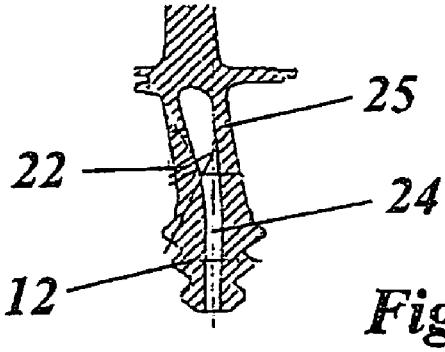
Fig.4

COOLED BLADE OR VANE FOR A GAS TURBINE

This application claims priority under 35 USC § 119 to German Application No. 103 31 635.3 filed Jul. 12, 2003 and is a Continuation under 35 USC § 120 of International Application No. PCT/EP2004/051309, filed Jun. 30, 2004, the contents of which are incorporated by reference herein in their entireties.

TECHNICAL FIELD

The present invention deals with the field of gas turbine technology. It relates to a cooled blade or vane for a gas turbine.

BACKGROUND

A blade or vane of this type is known for example from U.S. Pat. No. 4,278,400.

Modern high-efficiency gas turbines use blades or vanes which are provided with a cover strip and, during operation, are exposed to hot gases at temperatures of more than 1200 K and pressures of more than 6 bar.

FIG. 1 illustrates a basic configuration of a blade or vane with cover strip of this type. The blade or vane 10 comprises a main blade or vane part 11 which toward the bottom merges via a blade or vane shank 25 into a blade or vane root 12. At the upper end, the main blade or vane part 11 merges into a cover-strip section 21, which, in a complete ring of blades or vanes, together with the cover-strip sections of the other blades or vanes, forms a continuous, annular cover strip. The main blade or vane part 11 has a leading edge 19, onto which the hot gas flows, and a trailing edge 20. A plurality of radial cooling ducts 13, 14 and 15, which are connected to one another in terms of flow by diverter regions 17, 18 and form a serpentine with a plurality of turns, are arranged in the interior of the main blade or vane part 11 (cf. the flow arrows in the cooling ducts 13, 14, 15 in FIG. 1).

On account of the single passage of the cooling medium through the cooling ducts 13, 14, 15 which are connected in series in the form of a serpentine, the temperature of the cooling medium increases as it flows through the cooling ducts, reaching a maximum in the final cooling duct 15 of the trailing edge 20. Therefore, under certain operating conditions the trailing edge 20 of the blade or vane 10 may reach excessively high temperatures in terms of the cooling medium and the blade or vane material or metal. The resulting mismatch of the metal temperature over the axial length of the blade or vane may lead to high-temperature creep and consequently to deformation of the trailing edge 20. A secondary effect of the trailing-edge deformation for a blade or vane with cover strip as shown in FIG. 1 is tilting of the cover-strip segments 21 in the axial, radial and circumferential directions. The tilting of the cover-strip segments 21 can lead to the gaps between individual cover-strip segments opening up, allowing high-temperature hot gas to enter the cover-strip cavity. This can significantly increase the temperatures of the cover-strip metal and can rapidly give rise to creeping of the cover strip and ultimately can lead to high-temperature failure of the cover strip.

Document U.S. Pat. No. 4,278,400, which was mentioned in the introduction, has already proposed a multiple supply of medium for cooling blades or vanes with a cooled tip and finely distributed cooling openings at the leading edge (film cooling). An ejector is arranged transversely to the direction of flow of the main cooling stream at the end of a 90° diversion of the main cooling stream, which injector injects an additional stream of cooler cooling medium into the cooling duct running along the trailing edge. The ejector is supplied with cooling medium via a duct running radially through the root. The cooling medium which flows out of the nozzle of the ejector at an increased velocity generates a reduced pressure, which draws the heated cooling medium out of the cooling duct of the leading edge into the cooling duct of the trailing edge. Approximately 45% of the cooling medium flowing along the leading edge emerges through the cooling openings at the leading edge. 40% is sucked in by the injector. The remainder is discharged through cooling openings at the blade or vane tip.

This known way of effecting multiple supply of cooling medium has various drawbacks: the injector hugely changes the pressure conditions and flow conditions in the cooling ducts compared to the configuration with a single supply through the inlet of the cooling duct at the leading edge. In particular, it is necessary to find an equilibrium between the cooling medium flowing out for film cooling at the leading edge and the cooling medium sucked in by the injector and then to set this equilibrium. This requires a completely new design of the blade or vane cooling, which can only be adapted to changing requirements with difficulty. The injector principle and the associated reduced-pressure generation are unsuitable for blades or vanes without film cooling of the leading edge and blades or vanes with a cooled cover strip.

SUMMARY

Therefore, it is an object of the invention to provide a cooled blade or vane for gas turbines with a multiple supply of the cooling medium which avoids the drawbacks of known blades or vanes, can be applied to blades or vanes with a cooled cover strip and without film cooling of the leading edge, and can be realized easily and without major additional outlay even for existing blade or vane configurations.

An exemplary core idea of the invention consists in the additional stream being supplied via bores which run transversely through the blade or vane or the blade or vane shank and are in direct or indirect communication with the diverting region. The pressure and temperature of the additional stream supplied through the core opening are in this case the same as for the main stream flowing into the main cooling inlet. The supply via the bores produces a mixture of the two streams, which leads to significantly improved cooling of the trailing edge of the blade or vane.

The bores may open out directly into the diverting region. However, they may also open out into a radially running duct beneath the diverting region, which is in communication with the diverting region.

A first preferred embodiment of the invention is characterized in that a radially oriented core opening is provided in the blade or vane root, and in that the bores run through the blade or vane shank and open out into the core opening.

According to a second preferred embodiment of the invention, there are at least two opposite bores which run obliquely upward in the direction of flow and each include an angle of between 30 and 90 with the vertical. In particular, the bores are arranged staggered in the radial and axial directions, with the bores having a predetermined internal diameter, the radial distance between the bores, standardized on the basis of the internal diameter, being in the range between 1 and 4, and the axial distance, standardized on the basis of the internal diameter, being in the range between 0 and 3, and the radial distance between the upper bore and the second diverting region, standardized on the basis of the internal diameter, being in the range between 1 and 4.

To realize the multiple supply of cooling medium in existing blade or vane configurations, it is particularly expedient if, according to a second preferred embodiment, there are second means, which ensure that the main stream of the cooling medium remains substantially unchanged through the first cooling duct despite the addition of the additional stream. This is achieved in particular by virtue of the fact that the second means comprise additional outlet openings, which are arranged between the main cooling inlet and the second diverting region and through which a partial stream of the main stream of cooling medium emerges. In this context, it is particularly favorable if, according to a refinement, the blade or vane, at the upper end, has a cover-strip section, and the additional outlet openings are bores arranged in the cover-strip section. This simultaneously allows significantly improved cooling of the cover strip.

BRIEF DESCRIPTION OF THE DRAWINGS

The invention is to be explained in more detail below on the basis of exemplary embodiments in conjunction with the drawing, in which:

FIG. 2 shows the root region of the blade or vane from FIG. 1 in the form of an enlarged illustration with two bores for supplying the additional stream of cooling medium;

FIGS. 3, 4 each show a section through the root of the blade or vane from FIG. 2 in a plane, which is perpendicular to the sectional plane in FIG. 2, through one of the two bores for supplying the additional stream of cooling medium;

DETAILED DESCRIPTION

Figure 1:
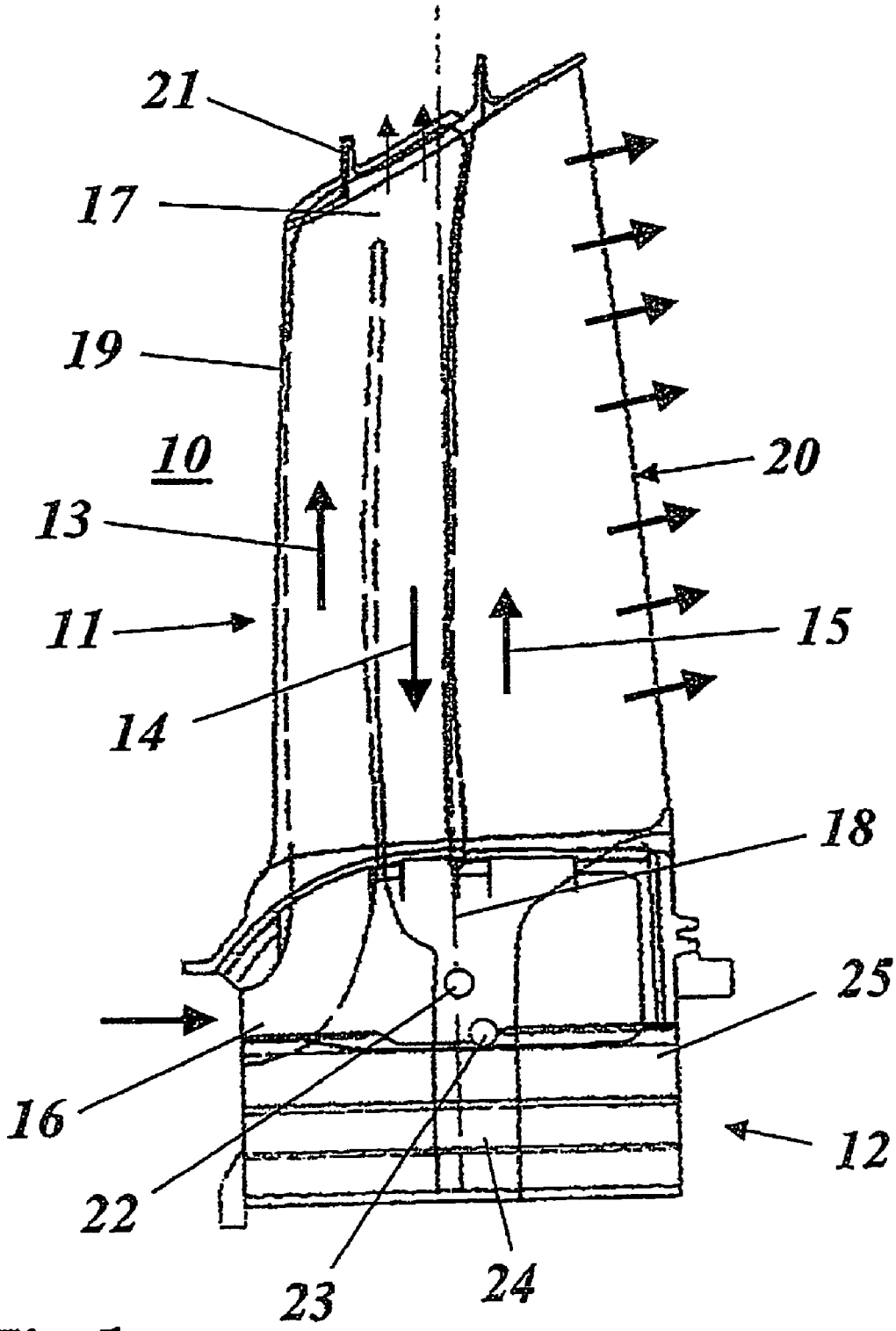
FIG. 1 shows a longitudinal section through the configuration of a cooled gas turbine blade or vane with a multiple supply of the cooling medium and a cooled cover strip in accordance with a preferred exemplary embodiment of the invention.
Figure 5:
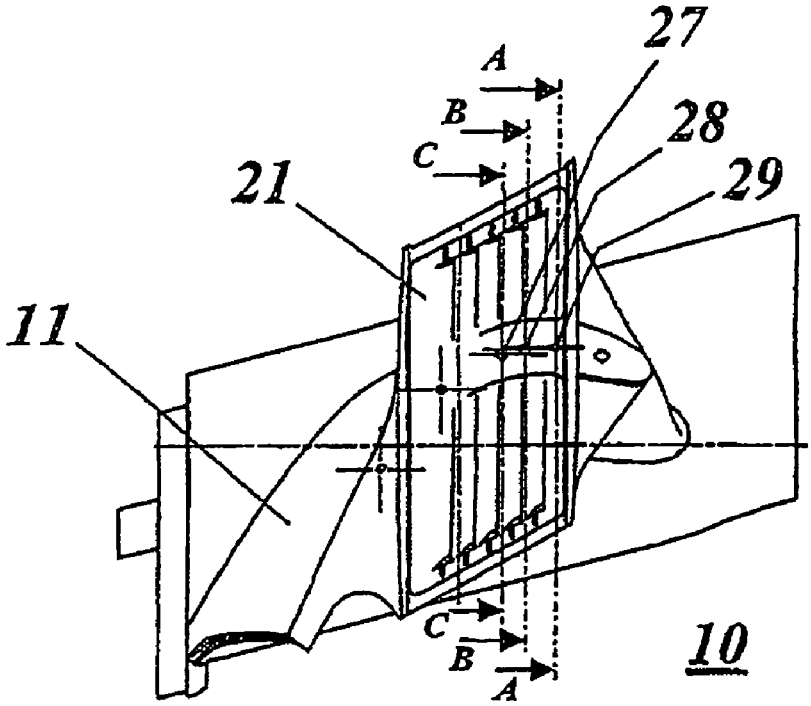
FIG. 5 shows a plan view from above of the cover-strip section of the blade or vane shown in FIGS. 1, 2.
Figure 6:
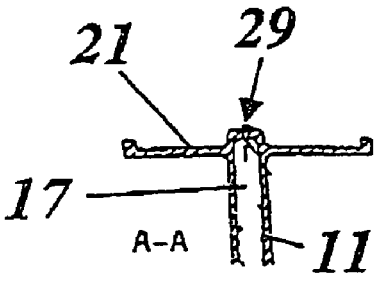
FIGS. 6-8 show various sections through the cover-strip region of the blade or vane from FIGS. 1, 2 along the parallel section planes A-A, B-B and C-C shown in FIG. 5.
Figure 7:
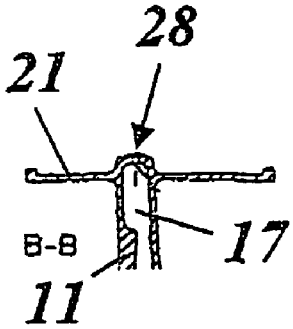
Figure 8:
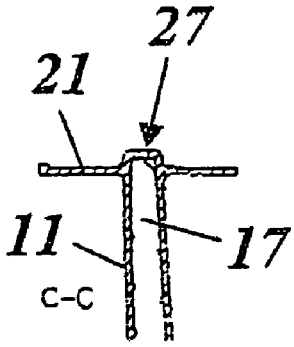

One preferred exemplary embodiment of a cooled gas turbine blade or vane with a multiple supply of the cooling medium according to the invention is reproduced in FIGS. 1 to 4. The main stream of the cooling medium enters the cooling duct 13 from below through a main cooling inlet 16 in the region of the blade or vane shank 25 and in part emerges again through openings in the cover-strip section 21 (bores 27, . . . , 29 in FIGS. 5 to 8) and in part emerges again along the trailing edge 20 (cf. the arrows shown in FIG. 1 at the cover-strip section 21 and at the trailing edge 20).

Additional cooling medium is supplied through the blade or vane shank 25 and a core opening 24 that is present in the blade or vane root by means of two bores 22, 23. As can be seen clearly from FIGS. 2 to 4, the bores 22, 23 are staggered in the radial and axial directions and are positioned opposite one another (FIGS. 3, 4). The bores 22, 23 are inclined at an angle of between 30° and 90 with respect to the vertical, running obliquely upward in the direction of flow (from the outside inward). The bores 22, 23 end in the core opening 24 in the blade or vane root 12. They are therefore machined in the region of the blade or vane 10 which serves to support and remove the casting core and is therefore already present. If there is no core opening, i.e. if the diverting region 18 does not have a connection to the outside, however, the bores 22, 23 may also run further upward and open out directly into the diverting region 18. Furthermore, it is conceivable for a radially arranged quartz rod to be provided instead of the core opening, ensuring that the bores are connected to the diverting region.

The purpose of the multiple supply of cooling medium is for cooler cooling medium to be introduced directly into the trailing-edge region of the blade or vane 10. This introduction is carried out in such a way that the main stream of the cooling medium, supplied through the main cooling inlet 16, is impeded or blocked to the minimum possible extent. The axial distance x between the bores 22 and 23, standardized on the basis of the diameter d of the bores 22, 23, is preferably in a range of x/d between 0 and 3 (cf. FIG. 2). The radial distance y between the bores 22 and 23, standardized on the basis of the diameter d, is preferably in a range of y/d between 1 and 4 (cf. FIG. 2). The distance between the upper bore 22 and the second inner diverting region 18, standardized on the basis of d, is preferably in a range of l/d between 1 and 4 (FIG. 2).

In addition to this supply of colder cooling medium, further bores 27, 28, 29 are provided in the cover-strip section 21 of the blade or vane 10 (FIGS. 5 to 8). The purpose of these additional bores 27, 28, 29 is to ensure that the mass flow of the cooling medium in the front cooling duct 13 remains substantially unchanged despite the supply of the additional cooling medium through the bores 23, 24. At the same time, the cooling medium which emerges through the bores 27, 28, 29 serves to actively cool the cover-strip section. The cooling bores 27, 28, 29 in the cover-strip section 21 preferably have an internal diameter in the range between 0.6 mm and 4 mm. All three bores 27, 28, 29 are positioned and dimensioned in such a way at the cover-strip section 21 that there is an uneven jet penetration into the main stream of the cover-strip cavity.

The cooling medium is at the same pressure and temperature at the two feed locations for the cooling medium, namely at the main cooling inlet 16 and at the bores 22, 23. The cooling medium main stream is therefore mixed with the additional stream within the diverting region 18 in a way which leaves the pressure and flow velocity substantially unchanged. In the diverting region 18, the main stream is diverted through approximately 135° The additional stream is then advantageously supplied at a point in the diverting region 18 where the main stream has already been diverted through approximately 90°. If—starting from a blade or vane configuration without a multiple feed of the cooling medium—bores 22, 23 and bores 27, . . . , 29 for supplying and discharging cooling medium are provided on the region of the blade or vane root 12 and in the cover-strip section 21 in accordance with FIG. 1, the cooling in the region of the trailing edge 20 is significantly improved without the main cooling stream and therefore the cooling of the remainder of the blade or vane being altered. In addition, active cooling of the cover-strip section 21 is obtained.

If the blade or vane does not have a cover strip through which some of the cooling-medium stream emerges, it is necessary to widen the cross section of the second cooling duct 15 in such a way that it takes account of the additional stream which is admixed in the second diverting region 18.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF DESIGNATIONS

10 Blade or vane
11 Main blade or vane part
12 Blade or vane root
13, 14, 15 Cooling duct
16 Main cooling inlet
17, 18 Diverting region
19 Leading edge
20 Trailing edge
21 Cover-strip section
22, 23 Bore
24 Core opening
25 Blade or vane shank
27, . . . , 29 Bore
d Internal diameter of the bores 22, 23
l Distance between the upper bore 22 and the second diverting region
y Distance between the bores 22, 23 in the radial direction
x Distance between the bores 22, 23 in the axial direction

The invention claimed is:

1. A cooled blade or vane for a gas turbine, having an installed radial direction and an installed axial direction, which blade or vane has a main blade or vane part, which starts from a blade or vane root and a blade or vane shank and extends in the radial direction, and the main blade or vane part having a leading edge and a trailing edge, as well as, within the main blade or vane part, a plurality of cooling ducts which extend in the radial direction, are connected in series in terms of flow and of which a first cooling duct is arranged along the leading edge and a second cooling duct is arranged along the trailing edge, which first and second cooling ducts have a direction of through-flow for a main stream of a cooling medium which extends in the installed radial direction starting from the blade or vane root, a downstream end of the first cooling duct being in fluid communication, via a first diverting region, a third cooling duct arranged between the first and second cooling ducts, and a second diverting region, with an inflow-side end of the second cooling duct, and first means being provided, through which an additional stream of cooling medium is added from the outside to the heated main stream of the cooling medium flowing from the third cooling duct into the second cooling duct, wherein the first means comprise bores which are in communication with the second diverting region, wherein a core opening oriented in the installed radial direction is arranged in the blade or vane root, and wherein the bores run through the blade or vane shank and open out into the core opening.

2. A cooled blade or vane for a gas turbine, having an installed radial direction and an installed axial direction, which blade or vane has a main blade or vane part, which starts from a blade or vane root and a blade or vane shank and extends in the radial direction, and the main blade or vane part having a leading edge and a trailing edge, as well as, within the main blade or vane part, a plurality of cooling ducts which extend in the radial direction, are connected in series in terms of flow and of which a first cooling duct is arranged along the leading edge and a second cooling duct is arranged along the trailing edge, which first and second cooling ducts have a direction of through-flow for a main stream of a cooling medium which extends in the installed radial direction starting from the blade or vane root, a downstream end of the first cooling duct being in fluid communication, via a first diverting region, a third cooling duct arranged between the first and second cooling ducts, and a second diverting region, with an inflow-side end of the second cooling duct, and first means being provided, through which an additional stream of cooling medium is added from the outside to the heated main stream of the cooling medium flowing from the third cooling duct into the second cooling duct, wherein the first means comprise bores which are in communication with the second diverting region, wherein there are at least two opposite bores, the opening of which faces toward the blade or vane head in the interior of the blade or vane and which in each case include an angle of between 30° and 90° with the installed radial direction.

3. The blade or vane as claimed in claim 2, wherein the bores are arranged offset with respect to one another in the installed radial direction and in the installed axial direction.

4. The blade or vane as claimed in claim 3, wherein the bores have a predetermined internal diameter, the distance between the bores in the installed radial direction, based on the internal diameter, is in the range between 1 and 4, and wherein the distance in the installed axial direction, based on the internal diameter, is in the range between 0 and 3.

5. The blade or vane as claimed in claim 4, wherein the radial distance between the upper bore and the second diverting region, based on the internal diameter, is in the range between 1 and 4.

6. A cooled blade or vane for a gas turbine, having an installed radial direction and an installed axial direction, which blade or vane has a main blade or vane part, which starts from a blade or vane root and a blade or vane shank and extends in the radial direction, and the main blade or vane part having a leading edge and a trailing edge, as well as, within the main blade or vane part, a plurality of cooling ducts which extend in the radial direction, are connected in series in terms of flow and of which a first cooling duct is arranged along the leading edge and a second cooling duct is arranged along the trailing edge, which first and second cooling ducts have a direction of through-flow for a main stream of a cooling medium which extends in the installed radial direction starting from the blade or vane root, a downstream end of the first cooling duct being in fluid communication, via a first diverting region, a third cooling duct arranged between the first and second cooling ducts, and a second diverting region, with an inflow-side end of the second cooling duct, and first means being provided, through which an additional stream of cooling medium is added from the outside to the heated main stream of the cooling medium flowing from the third cooling duct into the second cooling duct, wherein the first means comprise bores which run transversely through the blade or vane shank and which are in fluid communication with the second diverting region.

7. The blade or vane as claimed in claim 6, wherein there are second means which ensure that the main stream of the cooling medium remains substantially unchanged through the first cooling duct despite the addition of the additional stream.

8. The blade or vane as claimed in claim 7, wherein the second means comprise additional outlet openings which are arranged between the main cooling inlet and the second diverting region and through which a partial stream of the main stream of cooling medium emerges.

9. The blade or vane as claimed in claim 8, wherein the blade or vane, at the upper end, has a cover-strip section, and wherein the additional outlet openings are bores arranged in the cover-strip section.

10. The blade or vane as claimed in claim 9, wherein in the cover-strip section there are at least three bores, which have an internal diameter in the range between 0.6 mm and 4 mm.

11. The blade or vane as claimed in claim 6, wherein the second cooling duct has a cross-sectional widening corresponding to the admixed additional stream.

12. The blade or vane as claimed in claim 6, wherein the second diverting region opens out directly into the second cooling duct.

13. The blade or vane as claimed in claim 6, wherein the first cooling duct opens out directly into the first diverting region, in that the first diverting region opens out directly into the third cooling duct, in that the third cooling duct opens out directly into the second diverting region, and in that the second diverting region opens out directly into the second cooling duct.

14. The blade or vane as claimed in claim 6, wherein the blade or vane has precisely the first, the second, and the third cooling ducts.

* * * * *